United States Patent [19]

Havel

[11] Patent Number: 4,965,561

[45] **Date of Patent: * Oct. 23, 1990**

[54] CONTINUOUSLY VARIABLE COLOR OPTICAL DEVICE

[76] Inventor: Karel Havel, 15 Kensington Rd. Apt. #704, Bramalea Ontario, Canada, L6T 3W2

[ * ] Notice: The portion of the term of this patent subsequent to Jul. 4, 2006 has been disclaimed.

[21] Appl. No.: 322,341

[22] Filed: Mar. 13, 1989

Related U.S. Application Data

[62] Division of Ser. No. 922,847, Oct. 24, 1986, Pat. No. 4,845,481, which is a division of Ser. No. 817,114, Jan. 8, 1986, Pat. No. 4,647,217.

[51] Int. Cl.[5] ..... G09G 3/14

[52] U.S. Cl. ..... 340/762; 340/701; 340/767; 340/815.1

[58] Field of Search ..... 340/701, 702, 703, 762, 340/756, 782, 793, 767, 815.03, 815.04, 815.1

[56] References Cited

U.S. PATENT DOCUMENTS

| | | | |
|---|---|---|---|
| 3,740,570 | 6/1973 | Kaelin et al. | 340/793 |
| 3,840,873 | 10/1974 | Usui | 340/815.1 |
| 3,924,227 | 12/1975 | Stolov | 340/702 |
| 4,488,149 | 12/1984 | Givens, Jr. | 340/762 |
| 4,845,481 | 7/1989 | Havel | 340/701 |

FOREIGN PATENT DOCUMENTS

| | | | |
|---|---|---|---|
| 3037500 | 4/1981 | Fed. Rep. of Germany | 340/701 |
| 3009416 | 9/1981 | Fed. Rep. of Germany | 340/762 |
| 0220844 | 4/1985 | German Democratic Rep. | 340/701 |
| 2158631 | 11/1985 | United Kingdom | 340/701 |

OTHER PUBLICATIONS

IBM Technical Disclosure Bulletin, "Electroluminescent Display", R. W. Landauer, vol. 8, No. 11, Apr. 1966.

Bill Wagner, "2-Color LED+Driver=Versatile Visual Effects", Oct. 20, 1980, EDN, vol. 25, No. 19.

*Primary Examiner*—Alvin E. Oberley
*Assistant Examiner*—Richard Hjerpe

[57] ABSTRACT

A variable color optical device comprises three light emitting diodes for emitting upon activation light signals of respectively different primary colors and means for blending the light signals to obtain a composite light signal of a composite color. The light emitting diodes are substantially simulteneously activated by pulses of a substantially constant amplitude. Color control selectively controls the durations of the pulses to control the portions of the primary colors, to thereby control the color of the composite light signal emitted from the optical device.

6 Claims, 2 Drawing Sheets

CONTINUOUSLY VARIABLE COLOR OPTICAL DEVICE

CROSS-REFERENCE TO RELATED APPLICATIONS

This is a division of my copending application Ser. No. 06/922,847, filed on Oct. 24, 1986, entitled Continuously Variable Color Display Device now U.S. Pat. No. 4,845,481, which is a division of my application Ser. No. 06/817,114, filed on Jan. 8, 1986, entitled Variable Color Digital Timepiece, now U.S. Pat. No. 4,647,217 issued on Mar. 3, 1987.

Reference is also made to my applications Ser. No. 06/839,626, filed on Mar. 14, 1986, entitled Variable Color Display Typewriter, now abandoned, and Ser. No. 06/819,111, filed on Jan. 15, 1986, entitled Variable Color Digital Multimeter, now U.S. Pat. No. 4,794,383 issued on Dec. 27, 1988.

BACKGROUND OF THE INVENTION

1. Field of the Invention This invention relates to variable color optical devices.

2. Description of the Prior Art

A display device described in U.S. Pat. No. 3,740,570, issued on June 19, 1973 to George R. Kaelin et al., uses special LEDs that exhibit different colors when subjected to different currents. The LEDs are biased by pulses of different amplitudes to achieve different colors of the display.

A circuit employing a dual-color LED driven by a dual timer is described in the article by Bill Wagner entitled 2-color LED+driver=versatile visual effects, published on Oct. 2, 1980 in EDN volume 25, No. 19, page 164. Since dual-color LEDs are connected to conduct currents in opposite directions, it would be impossible to forwardly bias them simultaneously.

SUMMARY OF THE INVENTION

In the principal object of this invention to provide a variable color optical device.

In summary, a variable color optical device of the invention comprises three light emitting diodes for emitting upon activation light signals of respectively different primary colors and means for blending the light signals to obtain a composite light signal of a composite color. The light emitting diodes are substantially simultaneously activated by pulses of a substantially constant amplitude. Color control selectively controls the durations of the pulses to control the portions of the primary colors, to thereby control the color of the composite light signal emitted from the optical device.

BRIEF DESCRIPTION OF THE DRAWINGS

In the drawings in which is shown the preferred embodiment of the invention.

Throughout the drawings, like characters indicate like parts.

DESCRIPTION OF THE PREFERRED EMBODIMENT

Figures 1, 2:
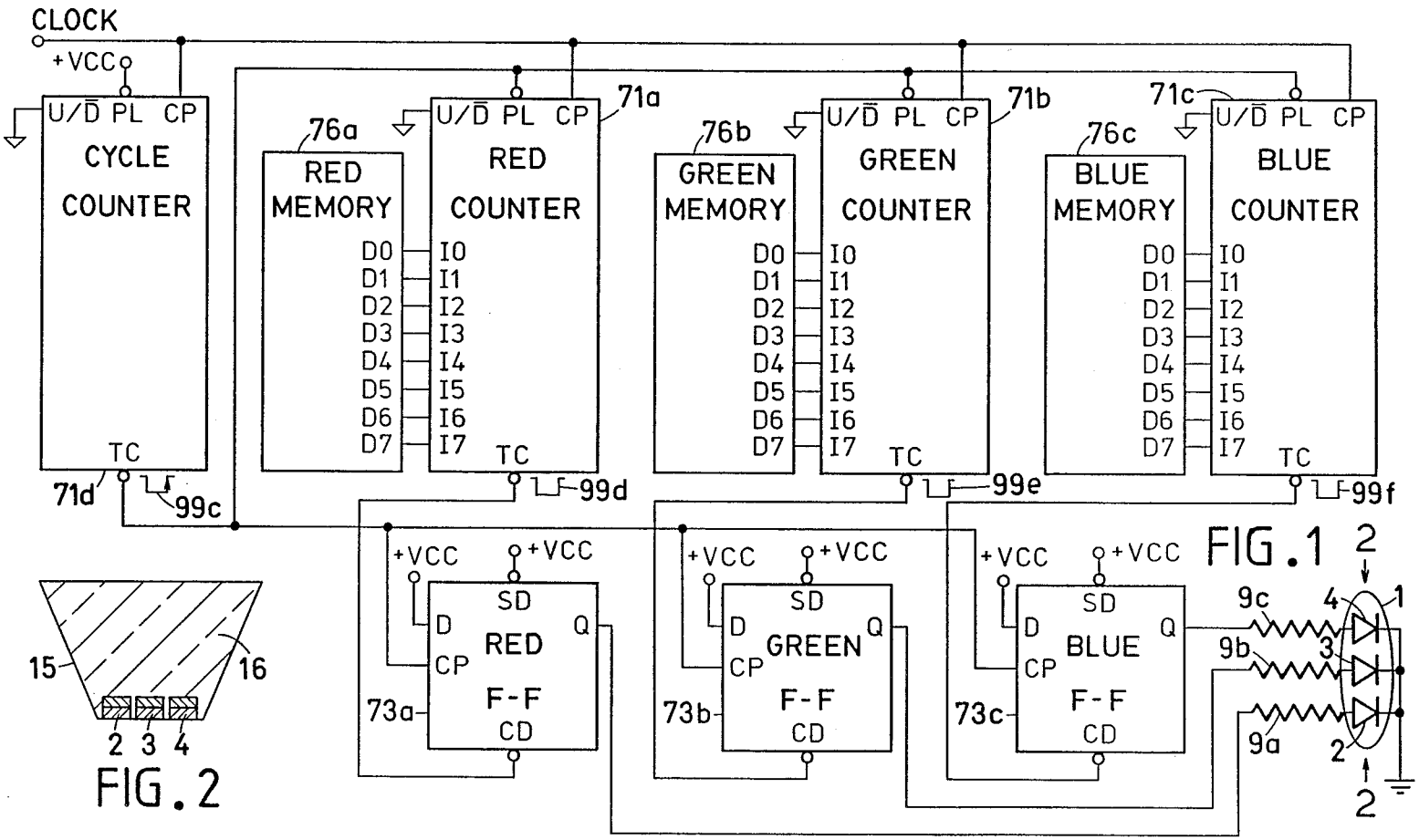
FIG. 1 is a schematic diagram of a variable color optical device of the invention.
FIG. 2 is an enlarged cross-sectional view of the variable color optical device of FIG. 1, taken along the line 2—2.
Figure 3:
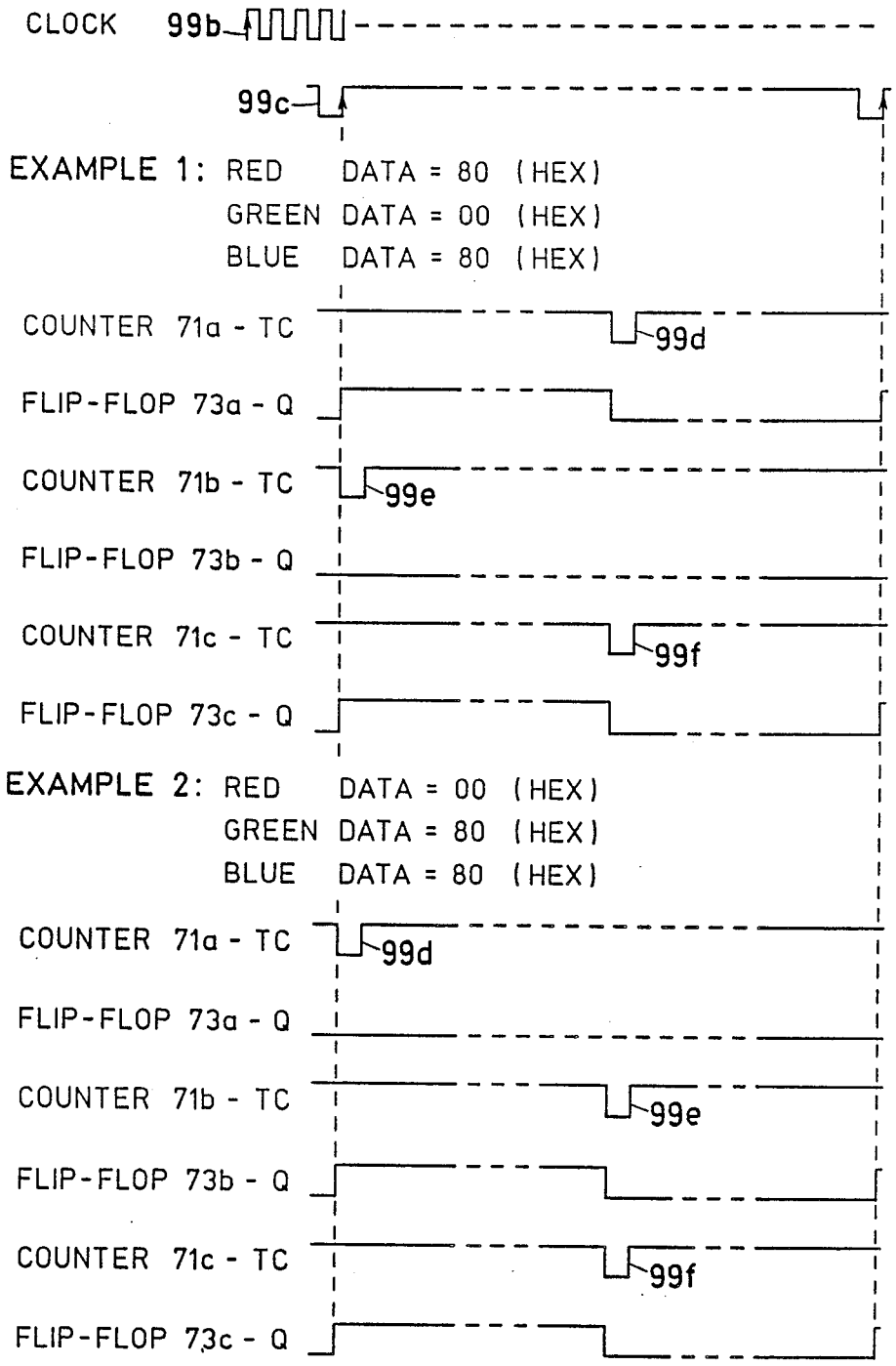
FIG. 3 is a timing diagram of the circuit shown in FIG. 1.

Referring now more particularly to the drawings, the description of the schematic diagram of a variable color optical device shown in FIG. 1 should be considered together with its accompanying timing diagram viewed in FIG. 3. A clock signal **99*b* of a suitable frequency (e.g., 10 kHz), to provide a flicker-free display, is applied to the Clock Pulse inputs CP of 8-bit binary counters 71*a*, 71*b*, 71*c*, and 71*d*, which have their Up/Down inputs U/$\overline{D}$ grounded, to step them down. At the end of each counter cycle, which takes 256 clock cycles to complete, the Terminal Count output TC of cycle counter 71*d* drops to a low logic level for one clock cycle, to generate a negative going pulse 99*c* for indicating that the lowest count was reached. The pulse 99*c* is utilized to load data into counters 71*a*, 71*b*, and 71*c*, by activating their Parallel Load inputs PL, from respective memories 76*a*, 76*b*, and 76*c*, and to trigger, by its rising edge, flip-flops 73*a*, 73*b*, and 73*c* to their set condition wherein their outputs Q rise to a high logic level. The data in red memory 76*a* represent the portions of red color, the data in green memory 76*b* represent the portions of green color, and the data in blue memory 76*c*** represent the portions of blue color to be blended.

The counters **71*a*, 71*b*, and 71*c* will count down, from the respective loaded values, until zero counts are reached. When the respective values of the loaded data are different, the length of time of the count-down is different for each counter 71*a*, 71*b*, and 71*c*. When a particular counter 71*a*, 71*b*, or 71*c* reaches zero count, its TC output momentarily drops to a low logic level, to activate the Clear Direct input CD of its associated flip-flop (red counter 71*a* resets its associated red flip-flop 73*a*, green counter 71*b* resets its associated green flip-flop 73*b*, and blue counter 71*c* resets its associated blue flip-flop 73*c*). Eventually, all flip-flops 73*a*, 73*b*, and 73*c*** will be reset.

It is thus obvious that the Q output of red flip-flop **73*a* is at a high logic level for a period of time proportional to the data initially loaded into red counter 71*a*. The Q output of green flip-flop 73*b* is at a high logic level for a period of time proportional to the data initially loaded into green counter 71*b*. The Q output of blue flip-flop 73*c* is at a high logic level for a period of time proportional to the data initially loaded into blue counter 71*c*.**

The Q outputs of red flip-flop **73*a*, green flip-flop 73*b*, and blue flip-flop 73*c* are respectively connected, via current limiting resistors 9*a*, 9*b*, and 9*c*, to red LED 2, green LED 3, and blue LED 4 of a variable color optical device 1 for respectively forwardly biasing them for variable periods of time, in accordance with the data stored in red memory 76*a*, green memory 76*b*, and blue memory 76*c*.**

The invention will be explained by the example of illuminating variable color optical device 1 in purple and blue-green colors. By referring now more particularly to the timing diagram viewed in FIG. 3, in which the waveforms are compressed to facilitate the illustration, the EXAMPLE 1 considers red memory data '80', green memory data '00', and blue memory data '80', all in a standard hexadecimal notation, to generate light of substantially purple color.

At the beginning of the counter cycle, pulse **99*c* simultaneously loads data '80' from red memory 76*a* into red counter 71*a*, data '00' from green memory 76*b* into green counter 71b, and data '80' from blue memory 76c into blue counter 71c. Simultaneously, flip-flops 73a, 73b, and 73c are set by the rising edge of pulse 99c. The counters 71a, 71b, and 71c will be thereafter stepped down by clock pulses 99b. The red counter 71a will reach its zero count after 128 clock cycles, in one half of the counter cycle. At that instant a short negative pulse 99d is produced at its output TC to reset red flip-flop 73a, which will remain reset for the remaining 128 clock cycles and will be set again by pulse 99c at the beginning of the next counter cycle, which will repeat the process. The green counter 71b will reach its zero count immediately and will produce at that instant a short negative pulse 99e at its output TC to reset green flip-flop 73b. The blue counter 71c will reach its zero count after 128 clock cycles and will produce at that instant a short negative pulse 99f at its output TC to reset blue flip-flop 73c**.

It is readily apparent that red flip-flop 73a was set for 128 clock cycles, or about 50% of the time, green flip-flop 73b was never set, and blue flip-flop 73c was set for 128 clock cycles, or about 50% of the time. Accordingly, red LED 2 is energized for about 50% of the time, green LED 3 is never energized, and blue LED 4 is energized for about 50% of the time. As a result of blending substantially equal portions of red and blue colors, variable color optical device 1 illuminates in substantially purple color.

The EXAMPLE 2 considers red memory data '00', green memory data '80', and blue memory data '80', to generate light of substantially blue-green color. At the beginning of the counter cycle, data '00' are loaded into red counter 71a, data '80' are loaded into green counter 71b, and data '80' are loaded into blue counter 71c. The red counter 71a will reach its zero count immediately, green counter 71b will reach its zero count after 128 clock periods, and so will blue counter 71c.

The red flip-flop 73a was never set, green flip-flop 73b was set for 128 clock pulses, or about 50% of the time, and so was blue flip-flop 73c. Accordingly, green LED 3 is energized for about 50% of the time, and so is blue LED 4. As a result of blending substantially equal portions of green and blue colors, variable color optical device 1 illuminates in substantially blue-green color.

It would be obvious to those skilled in the art that different data, defining different portions of the primary colors, may be written into memories 76a, 76b, and 76c for causing variable color optical device 1 to selectively illuminate in substantially any color of the spectrum.

In FIG. 2, red LED 2, green LED 3, and blue LED 4 are placed on the base of a segment body 15 which is filled with a transparent light scattering material 16. Red LEDs are typically manufactured by diffusing a p-n junction into a GaAsP epitaxial layer on a GaAs substrate; green LEDs typically use a GaP epitaxial layer on a GaP substrate; blue LEDs are typically made from SiC material.

When forwardly biased, LEDs 2, 3, and 4 emit light signals of red, green, and blue colors, respectively, which are scattered within transparent material 16, thereby blending the red, green, and blue light signals into a composite light signal that emerges at the upper surface of segment body 15. The color of the composite light signal may be controlled by varying the portions of the red, green, and blue light signals.

In brief summary, a variable color optical device was disclosed which comprises three light emitting diodes for emitting upon activation light signals of respectively different primary colors and means for blending the light signals to obtain a composite light signal of a composite color. Three counters in combination with three flip-flops are provided for substantially simultaneously activating the light emitting diodes by pulses of a substantially constant amplitude and for selectively controlling the durations of the pulses to control the portions of the primary colors, to thereby control the color of the composite light signal emitted from the optical device.

It would be obvious that persons skilled in the art may resort to numerous modifications in the construction of the preferred embodiment shown herein, without departing from the spirit and scope of the invention as defined in the appended claims. It is contemplated that the principles of the invention may be also applied to numerous diverse types of optical devices, such are luminescent devices, fluorescent devices, liquid crystal devices, plasma devices, and the like.

CORRELATION TABLE

This is a correlation table of reference characters used in the drawings herein, their descriptions, and examples of commercially available parts.

| # | DESCRIPTION | EXAMPLE |
|---|---|---|
| 1 | variable color optical device | |
| 2 | red LED | |
| 3 | green LED | |
| 4 | blue LED | |
| 9 | resistor | |
| 15 | segment body | |
| 16 | light scattering material | |
| 71 | 8-bit counter | 74F579 |
| 73 | D type flip-flop | 74HC74 |
| 76 | memory | 2716 |
| 99 | pulse | |

The embodiments of the invention in which an exclusive property or privilege is claimed are defined as follows:

1. A method of controlling a color of a variable color optical device which comprises a plurality of light sources for emitting upon activation light signals of respectively different primary colors and means for combining said light signals to obtain a composite light signal of a composite color, by repeatedly substantially simultaneously activating said light sources for brief time intervals by pulses of a substantially constant amplitude to cause them to emit light signals of said primary colors, and by selectively controlling durations of the time intervals of activation of respective light sources to control the portions of said primary colors, to thereby control the color of said composite light signal.

2. A variable color optical device comprising:

a plurality of light sources for emitting upon activation light signals of respectively different primary colors and means for combining said light signals to obtain a composite light signal of a composite color;

means for repeatedly activating said light sources by substantially simultaneously applying thereto pulses of a substantially constant amplitude for causing said light sources to emit light signals of said primary colors; and color control means for selectively controlling durations of the pulses applied to respective light sources to control the portions of said primary colors, to thereby control the color of said composite light signal.

3. A method of controlling a color of a variable color optical device which comprises a plurality of light emitting diodes for emitting when forwardly biased light signals of respectively different primary colors and means for combining said light signals to obtain a composite light signal of a composite color, by repeatedly substantially simultaneously forwardly biasing said light emitting diodes by pulses of a substantially constant amplitude to cause them to emit light signals of said primary colors, and by selectively controlling durations of the pulses to control the time intervals of forward biasing of respective light emitting diodes, to control the portions of said primary colors, to thereby control the color of said composite light signal.

4. A variable color optical device comprising:

a plurality of light emitting diodes for emitting when forwardly biased light signals of respectively different primary colors and means for combining said light signals to obtain a composite light signal of a composite color;

means for repeatedly forwardly biasing said light emitting diodes by substantially simultaneously applying thereto pulses of a substantially constant amplitude for causing said light emitting diodes to emit light signals of said primary colors; and color control means for selectively controlling durations of the pulses applied to respective light emitting diodes to control the portions of said primary colors, to thereby control the color of said composite light signal.

5. An optical device comprising:

a first light emitting diode for emitting when forwardly biased light signals of a first color;

a second light emitting diode for emitting when forwardly biased light signals of a second color;

a third light emitting diode for emitting when forwardly biased light signals of a third color;

means for combining light signals emitted by said first light emitting diode, by said second light emitting diode, and by said third light emitting diode to obtain a composite light signal of a composite color;

first means for repeatedly applying to said first light emitting diode pulses of a uniform amplitude for forwardly biasing it to emit light signals of said first color;

first means for selectively controlling durations of the pulses applied to said first light emitting diode to control the portion of said first color;

second means for repeatedly applying to said second light emitting diode pulses of a uniform amplitude for forwardly biasing it to emit light signals of said second color;

second means for selectively controlling durations of the pulses applied to said second light emitting diode to control the portion of said second color;

third means for repeatedly applying to said third light emitting diode pulses of a uniform amplitude for forwardly biasing it to emit light signals of said third color; and third means for selectively controlling durations of the pulses applied to said third light emitting diode to control the portion of said third color.

6. An optical device comprising:

a first light emitting diode for emitting when forwardly biased light signals of a first color;

a second light emitting diode for emitting when forwardly biased light signals of a second color;

a third light emitting diode for emitting when forwardly biased light signals of a third color;

means for combating light signals emitted by said first light emitting diode, by said second light emitting diode, and by said third light emitting diode to obtain a composite light signal of a composite color;

clock means for sequentially producing clock pulses;

a cycle counter responsive to said clock pulses for sequentially producing a timing signal;

first memory means for storing data representing a portion of said first color, said first memory means having a first memory output indicative of the values of the stored data;

a first counter responsive to said timing signal and to said first memory output, for extracting in accordance with the timing signal from said first memory means the value of the data and loading it as its counter contents, and to said clock pulses, for incrementing in accordance with said clock pulses its counter contents, said first counter having a first counter output for developing a first counter signal indicative when its counter contents reaches zero;

a first flip-flop responsive to said timing signal, for being set to its first condition when said timing signal occurs, and to said first counter signal, for being set to its second condition when said first counter signal occurs, said first flip-flop having an output indicative of its condition, said output being coupled to said first light emitting diode for forwardly biasing it while said first flip-flop is in its first condition;

second memory means for storing data representing a portion of said second color, said second memory means having a second memory output indicative of the values of the stored data;

a second counter responsive to said timing signal and to said second memory output, for extracting in accordance with the timing signal from said second memory means the value of the data and loading it as its counter contents, and to said clock pulses, for decrementing in accordance with said clock pulses its counter contents, said second counter having a second counter output for developing a second counter signal indicative when its counter contents reaches zero;

a second flip-flop responsive to said timing signal, for being set to its first condition when said timing signal occurs, and to said second counter signal, for being set to its second condition when said second counter signal occurs, said second flip-flop having an output indicative of its condition, said output being coupled to said second light emitting diode for forwardly biasing it while said second flip-flop is in its first condition;

third memory means for storing data representing a portion of said third color, said third memory means having a third memory output indicative of the values of the stored data;

a third counter responsive to said timing signal and to said third memory output, for extracting in accordance with the timing signal from said third memory means the value of the data and loading it as its counter contents, and to said clock pulses, for decrementing in accordance with said clock pulses its counter contents, said third counter having a third counter output for developing a third counter signal indicative when its counter contents reaches zero; and a third flip-flop responsive to said timing signal, for being set to its first condition when said timing signal occurs, and to said third counter signal, for being set to its second condition when said third counter signal occurs, said third flip-flop having an output indicative of its condition, said output being coupled to said third light emitting diode for forwardly biasing it while said third flip-flop is in its first condition.

* * * * *